US008863977B2

(12) United States Patent
Koppert et al.

(10) Patent No.: US 8,863,977 B2
(45) Date of Patent: Oct. 21, 2014

(54) VESSEL WITH ROTATIONALLY FREE BASE FLANGE

(75) Inventors: Jan Jacobus Matthijs Koppert, Rotterdam (NL); Gerrit Willem van Lindenberg, Delft (NL)

(73) Assignee: Advanced Lightweight Engineering B.V., Delft (NL)

( * ) Notice: Subject to any disclaimer, the term of this patent is extended or adjusted under 35 U.S.C. 154(b) by 0 days.

(21) Appl. No.: 13/989,876

(22) PCT Filed: Nov. 30, 2010

(86) PCT No.: PCT/NL2010/050804

§ 371 (c)(1),
(2), (4) Date: Jul. 24, 2013

(87) PCT Pub. No.: WO2012/074373

PCT Pub. Date: Jun. 7, 2012

(65) Prior Publication Data

US 2013/0299504 A1 Nov. 14, 2013

(51) Int. Cl.
*F17C 1/08* (2006.01)

(52) U.S. Cl.
USPC ..... 220/592; 220/586; 220/582

(58) Field of Classification Search
USPC ..... 220/582, 592, 586, 601
See application file for complete search history.

(56) References Cited

U.S. PATENT DOCUMENTS

| | | | | |
|---|---|---|---|---|
| 7,219,812 | B2 | 5/2007 | Debecker et al. | |
| 7,219,817 | B2 | 5/2007 | Panzarella | |
| 2009/0255940 | A1 * | 10/2009 | Murate et al. | 220/592 |

FOREIGN PATENT DOCUMENTS

| | | | |
|---|---|---|---|
| CN | 1074281 | A | 7/1993 |
| CN | 1419642 | A | 5/2003 |
| DE | 19631546 | C1 | 11/1977 |
| JP | 2001050494 | | 2/2001 |
| WO | WO 2007/079971 | | 7/2007 |
| WO | WO 2010/091062 | | 8/2010 |

OTHER PUBLICATIONS

International Search Report from PCT/NL2010/050804, dated Apr. 28, 2011.
Search Report from CN 201080071150.1 dated Apr. 22, 2014 (in English).

* cited by examiner

*Primary Examiner* — Stephen Castellano
(74) *Attorney, Agent, or Firm* — Swanson & Bratschun, L.L.C.

(57) ABSTRACT

Vessel, comprising a substantially fluid tight liner provided with a layer of fiber material, and a mount for mounting appendages to the vessel. The mount comprises a substantially cylindrical neck portion with a radially outwardly extending base flange. The base flange is axially fixedly but rotationally free held between the liner and the layer of fiber material.

14 Claims, 3 Drawing Sheets

VESSEL WITH ROTATIONALLY FREE BASE FLANGE

RELATED APPLICATIONS

This application is a 35 U.S.C. §371 national phase application of PCT/NL2010/050804 (WO 2012/074373), filed on Nov. 30, 2010, entitled "Vessel", which is incorporated herein by reference in its entirety.

The invention relates to a vessel, comprising a substantially fluid tight liner overwound with a layer of fibre material, and a mount for mounting appendages to the vessel.

Such fibre reinforced vessels are successfully used as pressure vessels and offer the advantage of a light-weight construction. These types of vessels are advantageously used as pressure vessels, e.g. as pressure vessel for gaseous fluids of pressures of up to 700 bar. Such vessels may also be used to hold liquid fluids or even solid fluids and fluids at atmospheric pressure. Up to now it has, however, been difficult to mount appendages to such vessels in a satisfactory way. In particular, it has been difficult to prevent that forces that such appendages are subjected to during use, damage the light-weight construction of the vessel.

The invention aims to alleviate the above-mentioned problem. Thereto the invention provides in a vessel, comprising a substantially fluid tight liner overwound with a layer of fibre material, and a mount for mounting appendages to the vessel, the mount comprising a substantially cylindrical neck portion with a radially outwardly extending base flange, wherein the base flange is axially fixedly but rotationally free held between the liner and the layer of fibre material. By holding the base flange of the mount rotationally free between the liner and the layer of fibre material, any torsional moment that is exerted on the appendage about its longitudinal axis need not be absorbed by the structure of the vessel. Rather than causing break-out of the mount, a torsional moment merely causes rotational movement of the mount.

By connecting the flange base to a rigid portion of the liner via a snap connection, overwinding the liner with fibre material while having the mount attached thereto can be facilitated. By embodying the snap connection as a circumferentially extending groove and notch connection that acts radially between the mount and the liner, a simple yet elegant snap connection may be obtained.

By providing the liner with a mounting recess such that the outer surface of the liner substantially smoothly connects to the top surface of the base flange, the layer of fibre material can be applied to the liner and connected mount in a smooth transition without risk of reduction of the strength of the fibre material.

By providing the mount with a cylindrical neck portion that surrounds an aperture of the liner, the mount may be very suitable for mounting an appendage that controls fluid communication with the vessel, such as a valve. Advantageously, such an appendage of the vessel may extend into the inside of the tubular neck portion. In particular, the appendage may be mounted directly or indirectly to the inside of the tubular neck portion. Direct mounting may, for example be embodied via a screw thread connection.

Advantageously, the liner may be provided with an edge portion that extends into the inside of the tubular neck portion, while a bottom portion of the appendage sealingly engages with the edge portion of the liner. This allows for a simple, yet reliable fluid tight construction of the vessel. Advantageously, the appendage may be axially fixedly, but rotationally free held in the inside of the tubular neck portion. This allows for a dual stage prevention of torsional loading of the vessel via the appendage. Such a construction may e.g. be embodied by providing a circumferential groove in the appendage and cross bores in the tubular neck portion through which retaining pins or clips extend.

In the vessel, the liner may provide for the fluid tightness, while fibre layer may provide for the strength of the construction. The liner may be flexible, and may e.g. be made of foil. However, the liner may also be constructed more rigidly, such that it retains its shape in unloaded condition. In such a configuration, overwinding the liner with fibre material may be facilitated by the shape retention properties of the liner. In a very elegant construction, the layer of fibre material may be free of matrix material inhibiting movement of the fibre. This allows the fibres to move upon deformation of the vessel, such that impact resistance of the vessel may be greatly increased compared to a vessel in which fibre material is wound in a matrix material that keeps the fibre in place. Preferably, the layer of fibre material comprises one or more fibres that are wound over the liner in a geodetical pattern, such that the or each fibre is loaded along its axis only. Such a vessel is e.g. disclosed in U.S. Pat. No. 7,219,812. The flexible fibre material may thus provide structural strength to the vessel, while the liner merely provides fluid tightness.

The radial outside of the layer of fibre material may be provided with a coating, e.g. a protective coating to prevent the fibre material from damage. Such a coating is preferably made of a flexible, tough ductile material, for example soft polyurethane (PUR).

The radial outside of the vessel may be provided with a handgrip portion that surrounds the mount. Such a handgrip portion may facilitate handling the vessel, but may also serve as a protective structure to shield the mount and appendage from transverse forces and pending moments.

The handgrip portion may be provided with a bottom surface that is bonded to the outside of the vessel. Such bonding may e.g. take place by fusing or gluing the bottom surface of the handgrip portion to the outer surface of the vessel that surrounds the mount. Such a handgrip portion may advantageously be bonded to a coating that has been provided on the radial outside of the layer of fibre material. Advantageously, such a handgrip portion may be mounted to another structure than the mount, e.g. to the outside of the vessel, so that direct transfer of forces exerted on the handgrip portion to the mount is prevented. Such a handgrip portion may also advantageously be used in any type of vessel, comprising a substantially fluid tight liner overwound with a layer of fibre material to which the handgrip portion is bonded. Preferably, the radial outside of the layer of fibre material is then provided with a coating, (i.e. also in vessels with a conventional mount for the appendage).

Further advantageous embodiments of the invention are described in the dependent claims.

The invention shall now be explained further using a number of exemplary embodiments that are shown in a drawing.

The drawings are schematical representations of preferred embodiments of the invention, which are provided as non-limiting examples.

Figure 1:
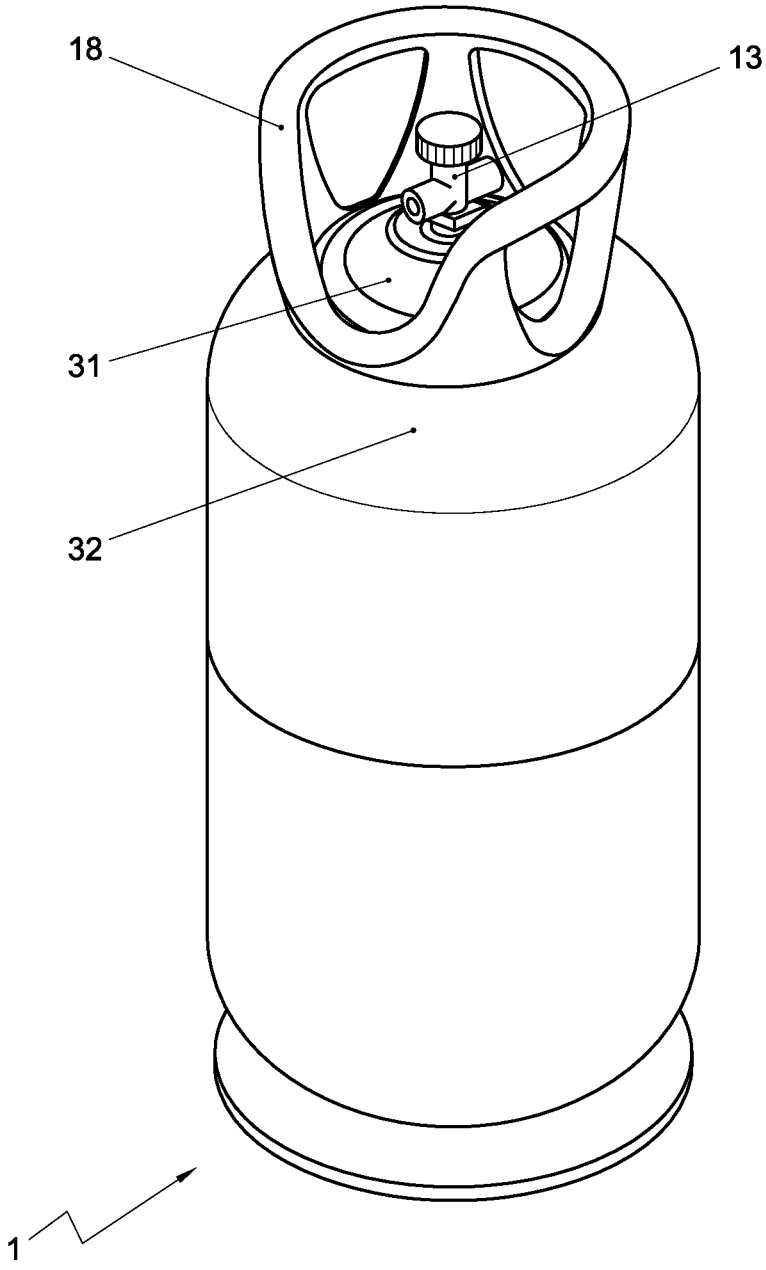
FIG. 1 shows a view of a vessel in accordance with the invention.

FIG. 1 shows a vessel 1. The vessel 1 may in this embodiment e.g. be a light-weight pressure vessel. In particular, the vessel 1 may be used to contain propane, and may have a test pressure of 30 bar. The volume of the vessel 1 may e.g. be 30.5 l, and the empty weight may e.g. be 6.5 kg. The weight of the propane gas contained in the vessel 1 may e.g. be 12.8 kg. The height of the vessel may e.g. be 710 mm, and the diameter may e.g. be 296 mm. Such a vessel 1 may for example be used to hold propane for a forklift truck.

Figure 2:
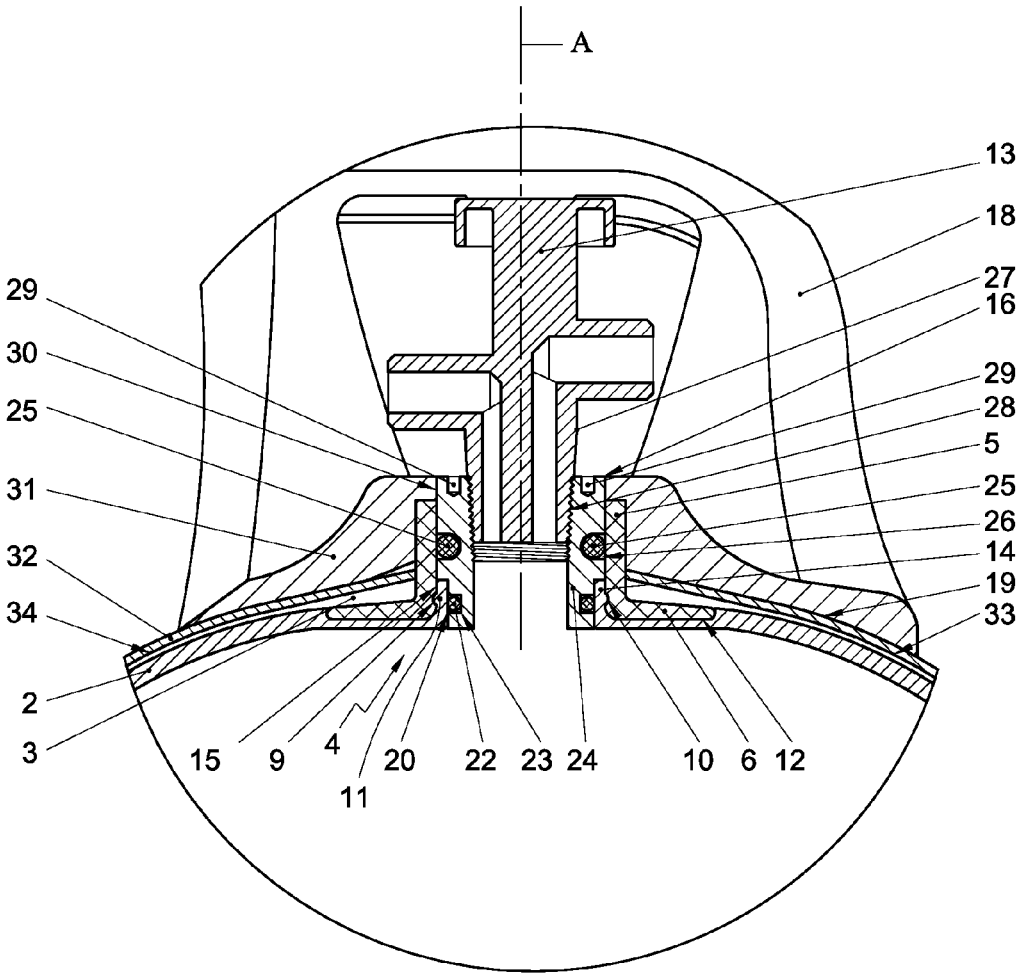
FIG. 2 shows a cross section of the top portion of the vessel of FIG. 1.

Referring to FIG. 2, the vessel 1 comprises a substantially fluid tight liner 2. The liner 2 is designed to hold fluid, in particular liquefied gas and gas at pressures up to 30 bar for a prolonged period of time, e.g. several days or months. The liner 2 of the exemplary embodiment retains its shape when unsubjected to the load of pressurized contents. The liner 2 may e.g. be made of a substantially rigid plastics material, e.g. HDPE and may e.g. be manufactured in a rotation moulding or blow moulding process. The liner 2 may as an alternative also be manufactured from a flexible material, such as a single- or multiply foil.

The liner 2 has over its outer surface 33 been provided with a layer 3 of fibre material. Such fibre material may e.g. be short or long strands of fibre embedded in a matrix material that inhibits movement of the fibres relative to each other. Such a layer 2 may e.g. be built up using resin-impregnated mats of woven or non-woven fibre material. The fibre material may e.g. be carbon fibre, glass fibre, Kevlar fibre or Aramide fibre or combinations thereof.

In the exemplary embodiment, the layer of fibre material is formed by a number of fibre filaments with which the liner 2 has been overwound. The fibre filaments may advantageously be wound dry, and may therefore be free of matrix material inhibiting movement of the fibre. In such a configuration, the layer 3 of fibre material may comprise one or more fibres that are wound over the outer surface 33 of the liner in a geodetical pattern, such that the or each fibre is loaded along its longitudinal axis only. The outer surface 33 of the liner may preferably be substantially fully covered with a layer 3 of fibre material such that the fibre material absorbs the mechanical load, and the liner 2 functions to provide fluid tightness. The radial outside 34 of the layer 2 of fibre material may be provided with a coating 32, e.g. to protect the layer 3 of fibre material from damage. Advantageously, the coating 32 is made of a flexible material so as to allow movement of the fibres that it is in contact with.

The vessel 1 is provided with a mount 4 for mounting appendages to the vessel 1. Such appendage may e.g. be a valve 13, but may e.g. also be a pressure meter, flow line or pressure redactor. The mount 4 comprises a substantially cylindrical neck portion 5 with a radially outwardly extending base flange 6. The base flange 6 is axially fixedly, but rotationally free held between the liner 2 and the layer 3 of fibre material. The mount 4 may therefore be prohibited from moving along its axis 7 with respect to the vessel 1, but may be allowed to rotate about its axis 7 without damaging the liner 2 or the layer 3 of fibre material. The rotation may be free in that is may rotate without end stops. However, such free rotation may still include a significant amount of friction, or may include indexation by a ratchet mechanism.

Referring again to FIG. 2, it is shown that the base flange 6 is supported on the outer surface 33 of the liner 2. In this embodiment, the liner 2 is provided with a mounting recess 12, such that the outer surface 33 of the liner substantially smoothly connects to the top surface of the base flange 6. In this embodiment, the base flange 6 is connected to a rigid portion of the liner 2 via a snap connection 9. The snap connection 9 may comprise a circumferentially extending groove 10 that cooperates with a notch 12, such that the groove- and notch connection acts radially between the mount 4 and the liner 2.

In the embodiment shown, the cylindrical neck portion 5 is tubular and corresponds with an aperture 20 of the vessel 1. As shown, the cylindrical neck portion 6 circumferentially surrounds an opening 21 in the liner 2. An edge portion 14 of the liner 2 extends into the inside 15 of the tubular neck portion 5. The edge portion 14 is sealingly engaged by a bottom portion 16 of the appendage 13. The appendage 13 is in the embodiment shown axially fixedly but rotationally free held in the inside 15 of the tubular neck portion 5.

A sealing ring 22 has been provided in a groove 23 of a cylindrical foot 24 of the appendage 13. The edge portion 14 of the liner 2 that extends into the inside 15 of the neck portion 5 has in this embodiment been machined to provide a smooth surface for sealing cooperation with the sealing ring 22 of the appendage. The cylindrical foot 24 itself has been fixed against axial movement relative to the mount 4 via a set of locking pins 25. The locking pins 25 extend through the neck portion 5 of the mount 4 and are received in a circumferential groove 26 of the cylindrical foot 24 of the appendage 13 so that it can rotate freely about its longitudinal axis 7 relative to the neck portion 5 of the mount 4. A valve housing 27 has been threadably engaged in the cylindrical foot 24 via a screw thread 28. A set of holes 29 has been provided in the top portion of the cylindrical foot 24 so that it may be engaged by a tool to restrain it against rotation, so that the valve housing 27 can be screwed into or out of the cylindrical foot 24.

A handgrip portion 18 has been provided on the top surface of the vessel 1 that surrounds the mount 4. The handgrip portion forms a crown that shields the mount 4 and the appendage mounted thereto from transverse loads. The handgrip portion 18 has been provided with a bottom surface 19 that is bonded to the outer surface of the vessel 1. In this embodiment, the bottom surface 19 of the handgrip portion 18 is glued to the outer surface of the coating 32 that is applied to the layer 3 of fibre material. Loads that are applied to the handgrip portion 18 are transferred to the coating 32.

Figure 3:
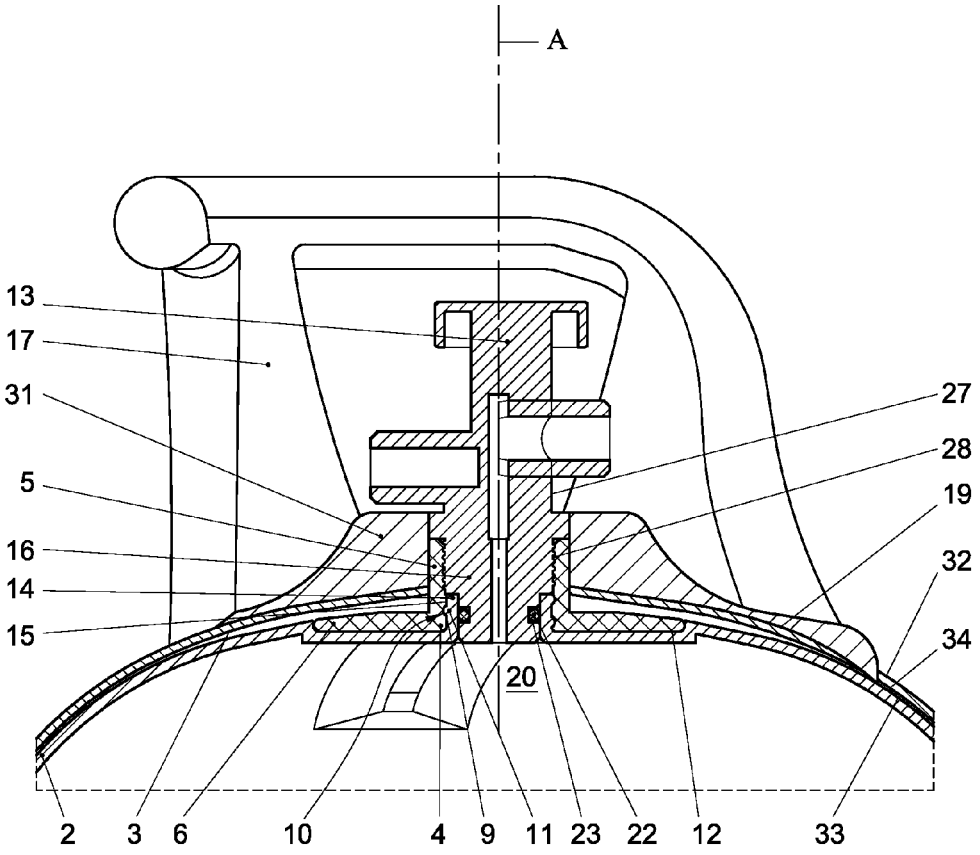
FIG. 3 shows an alternative construction for the top portion of the vessel of FIG. 1.

Referring to FIG. 3, a simplified embodiment of the appendage 13 is shown. In this embodiment, the appendage 13 is provided without a cylindrical foot, so that the lower portion of the valve housing 27 is directly threadably engaged in the inside 15 of the neck portion 5 of the mount 4. The appendage 13 may then rotate jointly with the mount 4. A protective barrier 31 of the handgrip portion 18 during use protects the neck portion 5 of the mount 4 against engagement by transverse forces. During normal operation, the protective barrier 31 shields the neck portion 5 of the mount 4, so that unscrewing the valve housing 27 from the neck portion with which it rotates freely and jointly is prevented.

It shall be clear to the skilled person that the invention is not limited to the exemplary embodiments described above, but that many variations are possible within the scope of the invention as defined in the appended claims.

REFERENCE SIGNS

1 vessel
2 liner
3 layer
4 mount
5 neck portion
6 base flange
7 axis A
8 rigid portion
9 snap connection
10 groove
11 notch
12 mounting recess

13 appendage
14 edge portion
15 inside neck portion
16 bottom portion appendage
17
18 handgrip portion
19 bottom surface
20 aperture
21 opening
22 sealing ring
23 groove
24 cylindrical foot
25 locking pins
26 circumferential groove
27 valve housing
28 screw thread
29 holes
30 top portion cylindrical foot
31 protective barrier
32 coating
33 outer surface
34 radial outside

The invention claimed is:

1. A vessel, comprising a substantially fluid tight liner provided with a layer of fibre material, and a mount for mounting appendages to the vessel, the mount comprising a substantially cylindrical neck portion with a radially outwardly extending base flange, characterized in that the base flange is axially fixedly but rotationally free held between the liner and the layer of fibre material.

2. The vessel according to claim 1, in which the base flange is connected to a rigid portion of the liner via a snap connection.

3. The vessel according to claim 2, in which the snap connection comprises a circumferentially extending groove and notch connection that acts radially between the mount and the liner.

4. The vessel according to claim 1, in which the liner is provided with a mounting recess, such that the outer surface of the liner substantially smoothly connects to the top surface of the base flange.

5. The vessel according to claim 1, in which the cylindrical neck portion is tubular, and corresponds with an aperture of the vessel.

6. The vessel according to claim 5, in which the appendage of the vessel extends into the inside of the tubular neck portion.

7. The vessel according to claim 5, in which an edge portion of the liner extends into the inside of the tubular neck portion, while a bottom portion of the appendage sealingly engages the edge portion of the liner.

8. The vessel according to claim 1, wherein the appendage is axially fixedly but rotationally free held in the inside of the tubular neck portion.

9. The vessel according to claim 1, wherein the liner retains its shape in unloaded condition.

10. The vessel according to claim 1, wherein the layer of fibre material is free of matrix material inhibiting movement of the fibre.

11. The vessel according to claim 1, wherein the layer of fibre material comprises one or more fibres that are wound over the liner in a geodetical pattern, such that the or each fibre is loaded along its longitudinal axis only.

12. The vessel according to claim 1, wherein the radial outside of the layer of fibre material is provided with a coating.

13. The vessel according to claim 1, in which the radial outside of the vessel is provided with a handgrip portion surrounding the mount.

14. The vessel according to claim 13, in which the handgrip portion is provided with a bottom surface that is bonded to the outer surface of the vessel.

* * * * *